US009604344B2

(12) United States Patent
Taneda et al.

(10) Patent No.: US 9,604,344 B2
(45) Date of Patent: Mar. 28, 2017

(54) DRY CLEANING CASING, DRY CLEANING APPARATUS AND ATTACHMENT METHOD OF SCREEN PLATE

(71) Applicants: Yuusuke Taneda, Kanagawa (JP); Akihiro Fuchigami, Kanagawa (JP); Yoichi Okamoto, Kanagawa (JP); Shozo Murata, Tokyo (JP); Kohji Tsukahara, Kanagawa (JP)

(72) Inventors: Yuusuke Taneda, Kanagawa (JP); Akihiro Fuchigami, Kanagawa (JP); Yoichi Okamoto, Kanagawa (JP); Shozo Murata, Tokyo (JP); Kohji Tsukahara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 173 days.

(21) Appl. No.: 14/499,573

(22) Filed: Sep. 29, 2014

(65) Prior Publication Data

US 2015/0101143 A1 Apr. 16, 2015

(30) Foreign Application Priority Data

Oct. 15, 2013 (JP) ..... 2013-214806
Jun. 27, 2014 (JP) ..... 2014-132746

(51) Int. Cl.
*B24C 7/00* (2006.01)
*B08B 7/04* (2006.01)
(Continued)

(52) U.S. Cl.
CPC ..... *B24C 7/0046* (2013.01); *B08B 5/04* (2013.01); *B08B 7/02* (2013.01); *B08B 7/04* (2013.01);
(Continued)

(58) Field of Classification Search
CPC ..... B24C 7/0046; B08B 5/04; B08B 7/02
(Continued)

(56) References Cited

U.S. PATENT DOCUMENTS 7,845,046 B2 * 12/2010 Milligan ..... A47L 5/24 15/352
8,595,895 B2 * 12/2013 Smith ..... A47L 5/24 15/344
(Continued)

FOREIGN PATENT DOCUMENTS

CN 101031370 A 9/2007
CN 101254502 A 9/2008
(Continued)

OTHER PUBLICATIONS

Extended European Search Report issued Mar. 11, 2015 in Patent Application No. 14188023.7.
(Continued)

*Primary Examiner* — Larry E Waggle, Jr.
*Assistant Examiner* — Henry Hong
(74) *Attorney, Agent, or Firm* — Oblon, McClelland, Maier & Neustadt, L.L.P.

(57) ABSTRACT

A dry cleaning casing of a dry cleaning apparatus includes a casing body including an internal space for flying a cleaning member, an opening to which a cleaning target is contacted to collide the cleaning member to the cleaning target, and an air introduction route to introduce external air to the internal space, by sucking air from the internal space while the opening is closed by the cleaning target, to generate rotating air flow for flying the cleaning member; a flow restriction member to define a rotation axis of the rotating air flow in the internal space; and a screen plate
(Continued)

made of a porous plate to block movement of the cleaning member while passing through substance removed from the cleaning target.

7 Claims, 11 Drawing Sheets

(51) Int. Cl.
*B08B 5/04* (2006.01)
*B08B 7/02* (2006.01)
*B08B 15/04* (2006.01)
*B24C 3/06* (2006.01)

(52) U.S. Cl.
CPC ..... *B08B 15/04* (2013.01); *B24C 3/06* (2013.01); *Y10T 29/49826* (2015.01)

(58) Field of Classification Search
USPC ..... 15/347
See application file for complete search history.

(56) References Cited

U.S. PATENT DOCUMENTS

2007/0107752 A1 5/2007 Fuchigami et al.
2007/0271724 A1* 11/2007 Hakan ..... A47L 5/225 15/329
2007/0283980 A1 12/2007 Okamoto et al.
2007/0295363 A1 12/2007 Fuchigami et al.
2008/0052953 A1 3/2008 Okamoto et al.
2008/0141484 A1 6/2008 Satoh et al.
2008/0250601 A1* 10/2008 Coburn ..... A47L 5/24 15/352
2009/0314312 A1 12/2009 Fuchigami et al.
2010/0307535 A1 12/2010 Fuchigami et al.
2011/0067731 A1 3/2011 Satoh et al.
2012/0117749 A1* 5/2012 Fuchigami ..... B08B 7/02 15/320
2012/0216363 A1 8/2012 Okamoto et al.
2012/0225613 A1 9/2012 Fuchigami et al.
2013/0118525 A1* 5/2013 Fuchigami ..... B08B 7/02 134/7
2013/0180552 A1 7/2013 Taneda et al.
2013/0192018 A1 8/2013 Fuchigami et al.
2013/0326840 A1 12/2013 Fuchigami et al.
2014/0020713 A1* 1/2014 Taneda ..... B08B 5/04 134/7

FOREIGN PATENT DOCUMENTS

CN 102553862 A 7/2012
CN 102649119 A 8/2012
CN 102712017 A 10/2012
CN 103180058 A 6/2013
DE 10 2011 087 429 A1 6/2013
EP 2 455 192 A2 5/2012
JP 2012-050973 3/2012
JP 2012-115823 6/2012
JP 2012-121017 6/2012
JP 2012-187567 10/2012
JP 2012-187568 10/2012
JP 2013-121575 A 6/2013
JP 2013-123688 A 6/2013
WO WO 2012/018100 A1 2/2012

OTHER PUBLICATIONS

Combined Chinese Office Action and Search Report issued Mar. 3, 2016 in Patent Application No. 201410538261.9.

* cited by examiner

DRY CLEANING CASING, DRY CLEANING APPARATUS AND ATTACHMENT METHOD OF SCREEN PLATE

CROSS-REFERENCE TO RELATED APPLICATION

This application claims priority pursuant to 35 U.S.C. §119(a) to Japanese Patent Application Nos. 2013-214806, filed on Oct. 15, 2013, and 2014-132746, filed on Jun. 27, 2014 in the Japan Patent Office, the disclosure of which are incorporated by reference herein in their entirety.

BACKGROUND

Technical Field

The present invention relates to a dry cleaning apparatus having a casing having an internal space for flying cleaning members in the casing by using rotating air flow to contact or collide the cleaning members to a cleaning target for cleaning the cleaning target, a dry cleaning casing used for the dry cleaning apparatus, and an attachment method of a screen plate.

Background Art

As to soldering process by a flow solder bath used for manufacturing printed boards, a mask jig is used to mask areas not receiving the soldering process. When the mask jig such as dip pallet and carrier palette is repeatedly used for many times, flux accumulates and sticks on a surface, with which the precision of mask deteriorates. Therefore, the mask jig is required to be cleaned periodically. Typically, the mask jig is cleaned by immersing the mask jig in solvent. The cleaning process of the mask jig consumes greater amount of solvent causing increased cost, and further an operator and environment are exposed to solvent. A method of jetting solvent to a cleaning target (i.e., without immersion) in an apparatus is known, but this method also consumes greater amount of solvent.

In view of this issue, a dry cleaning apparatus has been proposed, in which a suction unit is connected to a casing having an internal space. Negative pressure is generated in the casing to inflow external air from an air flow path disposed at one portion of an outer face of the casing with high speed to generate a rotating air flow in the casing. The rotating air flow can fly and circulate thin leaf cleaning members in the casing. An opening, which has a cross-section area greater than the above mentioned air flow path, is formed on the outer face of the casing. A cleaning target is attached to the opening to cover the opening, with which the above mentioned rotating air flow is generated, and the cleaning members collide a surface of the cleaning target with high speed at the opening. By repeating this cleaning operation, contamination can be removed from the cleaning target.

A flow restriction member having cylindrical shape or column shape is disposed at the center of the casing to define a rotation axis of the rotating air flow. An outer face of the flow restriction member becomes an internal face of the rotating air flow. Substance removed from the cleaning target (hereinafter, removed substance) passes through a screen plate having a greater number of holes that do not pass through the cleaning members, and recovered to a suction unit. The screen plate is a punched metal plate, and is disposed at a side of the suction unit in the casing, which is at a connection part of the casing and the suction unit as a face parallel to a movement direction of the rotating air flow. The screen plate is set perpendicular to the flow restriction member.

When the cleaning target is detached or removed from the opening, a greater amount of air inflows in the casing from the opening, and an air-inflow amount from the air flow path suddenly decreases, with which the rotating air flow disappears, and the cleaning members are adsorbed on the screen plate and retained in the casing. When a cleaning target is attached to the opening to cover the opening again under this condition, the rotating air flow is generated again to fly the cleaning members adsorbed on the screen plate. For example, JP-2012-050973-A and JP-2012-121017-A disclose a configuration having a flow restriction member as a porous member, in which the flow restriction member itself can function as a screen plate.

SUMMARY

In one aspect of the present invention, a dry cleaning casing of a dry cleaning apparatus useable for cleaning a cleaning target by impacting a cleaning member to the cleaning target by flying the cleaning member using an air flow is devised. The dry cleaning casing includes: a casing body including an internal space, connected to a suction unit; an opening to which the cleaning target is contacted, and an air introduction route to introduce external air to the internal space, by sucking air from the internal space while the opening is closed by the cleaning target, to generate rotating air flow for flying the cleaning member; a flow restriction member to define a rotation axis of the rotating air flow in the internal space, the flow restriction member having an inner space communicated to the internal space and used as a suction route for the suction unit; and a screen plate made of a porous plate to block movement of the cleaning member to the suction unit and to pass through substance removed from the cleaning target, the screen plate disposable on the flow restriction member along an outer face of the flow restriction member.

In another aspect of the present invention, a method of attaching a screen plate for a dry cleaning casing of a dry cleaning apparatus useable for cleaning a cleaning target by impacting a cleaning member to the cleaning target by flying the cleaning member using an air flow is devised. The dry cleaning casing includes a casing body including an internal space, connected to a suction unit, for flying the cleaning member; an opening to which the cleaning target is contacted to collide the cleaning member to the cleaning target; and an air introduction route to introduce external air to the internal space, by sucking air from the internal space while the opening is closed by the cleaning target, to generate rotating air flow for flying the cleaning member; a flow restriction member to define a rotation axis of rotating air flow in the internal space, the flow restriction member having an inner space communicated to the internal space and used as a suction route for the suction unit; and a screen plate made of a porous plate to block movement of the cleaning member to the suction unit and to pass through substance removed from the cleaning target, the screen plate disposable on the flow restriction member along an outer face of the flow restriction member. The method includes the steps of inserting the screen plate from the opening of the casing body; and inserting with pressure a front end of the screen plate into a guide member formed along a flow restriction member to attach the screen plate along an outer face of the flow restriction member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 6A and 6B are schematic cross-sectional views of a dry cleaning casing showing a method of attaching a screen plate by inserting the screen plate through an opening, in which FIG. 6A is a schematic cross-sectional view of the dry cleaning casing before inserting a front end of the screen plate into a guide member, and FIG. 6B is a schematic cross-sectional view of the dry cleaning casing after attaching the screen plate;

Figure 1:
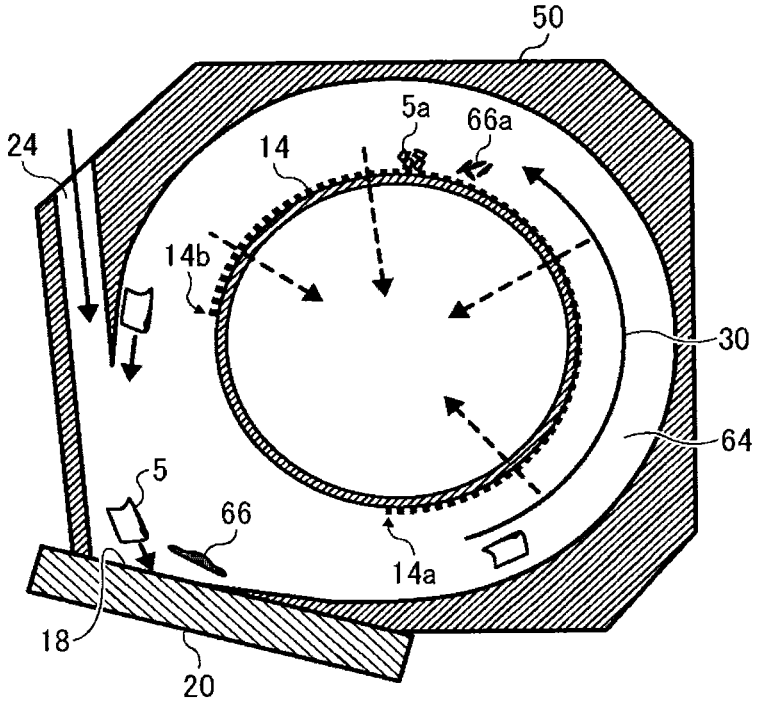
FIG. 1 is a schematic cross-sectional view of a dry cleaning casing according to a first example embodiment of the present invention.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner and achieve a similar result. Referring now to the drawings, an apparatus or system according to an example embodiment is described hereinafter.

As to a dry cleaning apparatus, types of cleaning member need to be changed depending on contamination types adhered on a cleaning target, in which size of cleaning member varies. For example, when contamination is hard and thick, cleaning members having a size of several millimeters (mm) or more and greater mass are collided for cleaning. When the contamination is soft and thin, cleaning members having a size of several tens of micro meters (μm) and smaller mass are collided for cleaning so that damage is not caused to a base member.

When the cleaning member is changed depending on types of contamination, a suitable mesh diameter of a screen plate used for separating contamination substance from the cleaning member changes, in which the "mesh diameter" means the hole diameter of the screen plate.

If the same dry cleaning apparatus is used when the cleaning member is changed, the mesh diameter of the screen plate may not match for separating the contamination substance from the cleaning members, with which the cleaning members are consumed with a greater amount, and cleaning capability deteriorates because the cleaning members having deteriorated its cleaning capability may remain in the casing. Therefore, when the type of cleaning member is changed, a screen plate having a suitable mesh diameter is requited to be selected and replaced to obtain efficient cleaning capability. However, replacement work of the screen plate is not easy for conventional dry cleaning apparatuses. A description is given of conventional replacement work of the screen plate.

As to conventional dry cleaning casings, when a disassembly work is conducted, disassembly starts at a side opposite to a side connected to a suction unit. If a screen plate is disposed in a direction parallel to a movement direction of rotating air flow, the screen plate is disposed at a connection part of the casing and the suction unit, which means the screen plate is disposed at a position farthest from the disassembly starting side in the casing. Therefore, when replacing the screen plate, almost entire parts of the casing need to be disassembled, which becomes a complex work. Further, because a greater number of the cleaning members rotate near the screen plate with high speed, sealing performance becomes important. Therefore, sealing is also required to be disassembled and assembled, which is also a complex work.

Sealing performance is important matter due to sticking of cleaning member. In a case of simple replacement configuration of the screen plate, the cleaning members may stick to a gap of replacement portion, with which the screen plate is damaged, or replacement becomes impossible due to clogging.

Other than complexity of disassembly/assembly works, the screen plate wears earlier depending on conditions. Cleaning members flying by the rotating air flow are likely concentrated at an outer side of ring-shaped flow space (i.e., outer side of rotating air flow) having the center at the flow restriction member with an effect of centrifugal force. Therefore, if the screen plate is disposed in a direction parallel to a movement direction of rotating air flow, contamination substance and cleaning members always friction with the screen plate.

Because a small diameter hole formed in a thick plate may be easily clogged, a screen plate formed with holes having a smaller mesh diameter becomes a thin plate. When a screen plate is replaced to a screen plate having thin thickness, the screen plate wears earlier due to friction with contamination substance and cleaning members, and then may be damaged.

In contrast, the flow restriction member itself can be configured to have the function of a screen plate. In this configuration, because the flow restriction member is integrated with the most outer cover, replacement work can conducted easily. Further, because the cleaning members do not concentrate at the inner side of rotating air flow, friction with the cleaning member becomes little. However, because the flow restriction member is used to define an inner side face of rotating air flow such as high-speed airflow, the flow restriction member is required to have a given level of stiffness. Because a given thickness or more is required to secure the given level of stiffness, and the mesh diameter becomes greater as thickness becomes greater. Therefore, it cannot be replaced with a flow restriction member having a smaller mesh diameter when the cleaning member is changed to some type.

When the type of cleaning member is changed, the screen plate can be replaced to a suitable one by preparing a plurality of dry cleaning casings including screen plates having different mesh diameters, in which disassembly work of the screen plate can be omitted, but a storage space of dry cleaning casings is required and cost increases. Further, if a screen plate having a smaller mesh diameter is used, deterioration still occurs earlier.

A description is given of an example embodiment an according to the present invention with reference to drawings. Firstly, a description is given of a basic configuration and function of conventional dry cleaning apparatus with reference to FIGS. 11 and 12, which can be used as a basic configuration of a dry cleaning apparatus of an example embodiment according to the present invention.

Figure 11A:
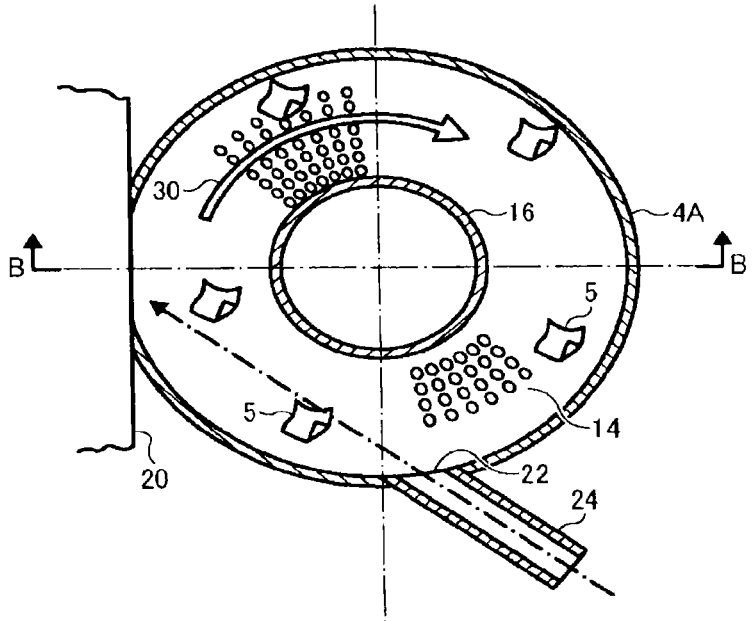
FIG. 11(a) RELATED ART
FIGS. 11(*a*) and 11(*b*) are schematic cross-sectional views of a conventional dry cleaning apparatus indicating a basic configuration of a dry cleaning apparatus.
Figure 11B:
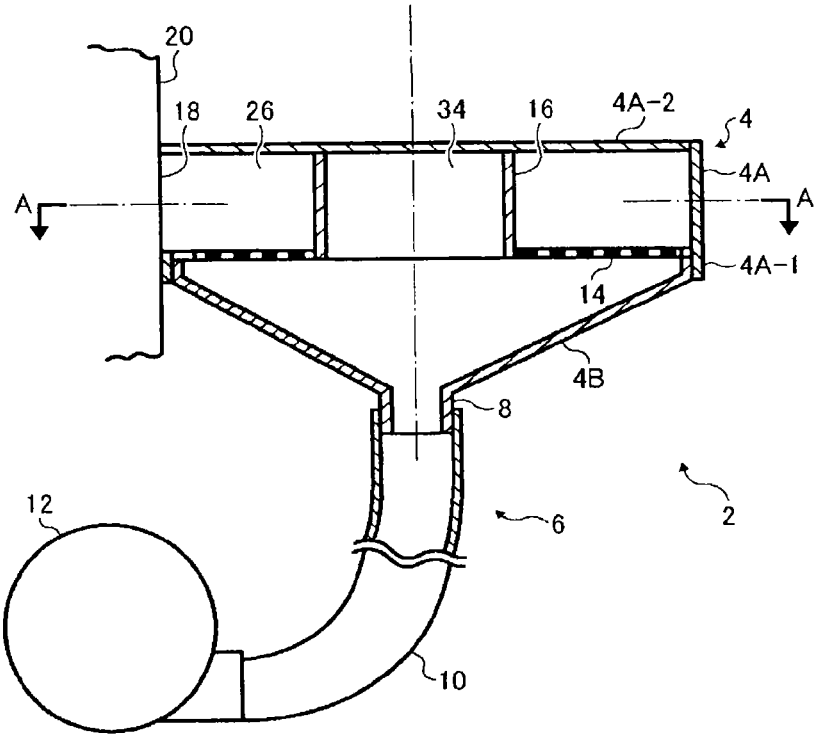
FIG. 11(b) RELATED ART

FIG. 11 is a schematic configuration of a dry cleaning apparatus 2 of conventional type. FIG. 11(*a*) is a cross-sectional view cut at A-A line, and FIG. 11(*b*) is a cross-sectional view cut at B-B line. The dry cleaning apparatus 2 includes a dry cleaning casing 4 (hereinafter also referred to as "casing 4") having a flying space for flying cleaning members 5 inside the dry cleaning casing 4, and a suction unit 6 to set negative pressure inside the casing 4. The casing 4 includes an upper casing 4A and a lower casing 4B integrated as one casing. The upper casing 4A is a cylinder shaped member that can be used as a casing body, and the lower casing 4B has an inverse conical shape. The terms of upper and lower are used for the simplicity of expressions with respect to the drawings, and may not be related to upper and lower direction of an actual apparatus.

The lower casing 4B has a suction port 8 used as a suction duct at the top of conical shape. The suction unit 6 includes a suction hose 10 and a suction device 12. The suction hose 10 is a flexible hose having one end connected to the suction port 8, and another end connected to the suction device 12. The suction device 12 can be a house vacuum cleaner, a vacuum motor, a vacuum pump, or an apparatus that can indirectly generate low or negative pressure by flowing fluid. Positional relationship of the upper face and bottom face are just for the simplicity of expression in the drawing.

A bottom face of the upper casing 4A has an engagement concave portion 4A-1 that can be connected to the upper end of the lower casing 4B, in which the upper casing 4A is detachable from the lower casing 4B, and an upper face 4A-2 of the upper casing 4A is sealed.

A porous plate such as a screen plate 14 is disposed at a bottom face portion of the upper casing 4A, which is a boundary with the lower casing 4B. The screen plate 14 is a punched metal plate having formed with holes. The screen plate 14 can block movement of the cleaning members 5 to the lower casing 4B when sucking the cleaning members 5. In FIG. 11(*a*), a part of the screen plate 14 is omitted. The size of the cleaning members 5 is enlarged for the simplicity of expression for the drawing. Hereafter, the cleaning members 5 may be referred to as the cleaning member 5.

The screen plate 14 is a porous plate having a greater number of small holes that does not pass through the cleaning member 5 but can pass through air and dust (e.g., substance removed from cleaning target), and the screen plate 14 can be a slit plate and a net. The material of screen plate 14 can be resin and metal having a smooth face. The screen plate 14 is disposed as a face perpendicular to the rotation axis of rotating air flow. With this configuration, air can flow in a direction along the screen plate 14, with which piling up of the cleaning member 5 can be prevented. To suppress attenuation of the rotating air flow, it is preferable to have a smooth face inside the casing 4 such as without step portions or concave/convex portions. In this description, air is used as an example of gas, which means gas is not limited to air.

By disposing the screen plate 14 at a position facing the rotating air flow, the cleaning member 5 adsorbed on the surface of the screen plate 14 can be peeled off and can be flown again. Material of the casing 4 is not limited to specific materials. To prevent adhesion of foreign particles and wearing by friction with the cleaning member 5, metal such as aluminum, stainless or the like is preferable. Further, material of the casing 4 can be resin.

A flow restriction member 16 having a cylinder shape is disposed at the center of the upper casing 4A while setting a cylinder axis of the upper casing 4A as the common axis of the flow restriction member 16 and the upper casing 4A. The flow restriction member 16 can be disposed as one part of the casing 4. The lower end of the flow restriction member 16 is fixed to the screen plate 14. The flow restriction member 16 is disposed to enhance or increase a flow rate of air by reducing a cross area of flow path of the rotating air flow.

By disposing the flow restriction member 16, a ring-shaped movement space of rotating air flow (i.e., flying space of the cleaning member 5) having a smooth wall face can be formed inside the upper casing 4A. Hereinafter, the ring-shaped movement space of rotating air flow (i.e., internal space) is referred to as "rotating flow path." The flow restriction member 16 is also used to set the rotation axis of rotating air flow. Depending on a shape of the upper casing 4A, the center axis of the flow restriction member 16 and the center axis of the upper casing 4A are not required to be aligned, but can be eccentric as long as the ring-shaped space can be secured.

An opening 18 is formed on one side of the upper casing 4A to contact or collide the cleaning member 5 flying by the rotating air flow to a cleaning target face of a cleaning target. The upper casing 4A is a cylinder shaped member having a height, which may be smaller than the diameter of the upper casing 4A, and the opening 18 is formed at the height side the upper casing 4A. With this configuration, as illustrated in FIG. 11(*a*), a layout of the casing 4 includes the opening 18 and other outer portions that are relatively far from a cleaning target 20. Therefore, the casing 4 contacts the cleaning target 20 locally at the opening 18, which means a pin point cleaning operation can be conducted. The opening 18 is formed by cutting a side face of the upper casing 4A in a direction parallel to the cylinder axis, and the opening 18 has a rectangular shape when viewed from a direction perpendicular to the cylinder axis.

Further, an air-inflow port 22 is formed at one side face of the upper casing 4A. An inlet 24, which can be used as a rotating air flow generator and an air flow path, is connected to the air-inflow port 22 from the outside of the upper casing 4A, and fixed to the upper casing 4A. The inlet 24 is disposed substantially parallel to the screen plate 14, and a direction of air flow by the inlet 24 is slanted with respect to the radius direction of the upper casing 4A, and a line extended from the center of the air flow path is directed to the opening 18. The inlet 24 has a width extending in a height direction of the upper casing 4A. For example, one inlet having a diameter or width set smaller than the height of the upper casing 4A can be disposed as the inlet 24, or a plurality of inlets can be disposed in the height direction of the upper casing 4A as the inlet 24 collectively.

As illustrated in FIG. 11(*a*), when the opening 18 is contacted and covered by the cleaning target 20, an internal space of the casing 4 becomes a closed space, and then external air inflows from the inlet 24 with high speed. This high-speed airflow accelerates the cleaning member 5 toward the opening 18, and generates rotating air flow 30 when the closed space is set. The generated rotating air flow 30 can blow off the cleaning member 5 adsorbed on the screen plate 14, and can re-fly the cleaning member 5.

The opening 18 has a given area size so that internal pressure at the air-inflow port 22 is set to atmospheric pressure or near the atmospheric pressure when the opening 18 is opened. Further, the air-inflow port 22 is disposed at a position so that internal pressure at the air-inflow port 22 can be set to atmospheric pressure or near the atmospheric pressure when the opening 18 is opened. In this configuration, when the opening 18 is not contacted to a cleaning target, the internal pressure at the air-inflow port 22 becomes close to atmospheric pressure, with which pressure difference with the external side decreases, and thereby air flow inflowing into the air-inflow port 22 decreases greatly. Further, when the opening 18 is not contacted to a cleaning target, air flow inflowing from the opening 18 increases, with which spillover of the cleaning member 5 from the casing 4 can be prevented.

Further, compared to the closed condition of the opening 18, when the opening 18 is opened, an amount of air inflow becomes two to three times. When the opening 18 is opened, the cleaning member 5 of thin leaf can be absorbed on the porous plate, and the cleaning member 5 does not re-fly, and therefore the cleaning member 5 does not spillover the outside of the casing 4. This is called as "absorption effect of cleaning member" when the opening 18 is opened. The cleaning member 5 may be a group of thin leaf cleaning members, but also mean a single thin leaf cleaning member. For example, one thin leaf cleaning member 5 is a thin leaf having an area from 1 $mm^2$ to 200 $mm^2$.

Material of the cleaning member 5 is film made of durable material such as polycarbonate, polyethylene terephthalate, acrylic resin, and cellulose resin having a thickness from 0.02 mm to 1.0 mm but not limited hereto. For example, depending on a cleaning target, thickness, size, and material of the cleaning member 5 can be changed to given effective thickness, size, and material. The material of the cleaning member 5 is not limited to resin, but can be a thin leaf of paper and cloth. Further, mineral such as mica, ceramic, glass, and metal foil can be used as the cleaning member 5 by forming material as thin and light weight member that can fly easily.

A ring-shaped internal space 26 of the upper casing 4A is a space for flying the cleaning member 5 using the rotating air flow 30 and contacting the cleaning member 5 to the cleaning target 20 closing the opening 18. An internal space 34 of the flow restriction member 16 is a space where the rotating air flow does not effect.

A description is given of a cleaning operation conductable using the above configured dry cleaning apparatus 2 with reference to FIG. 12, in which thickness of members are omitted for the simplicity of drawing, and the internal space 34 is indicated by hatching. FIGS. 12A(a) and 12A(b) illustrate a condition when the opening 18 is contacted and closed by the cleaning target 20. FIGS. 12B(a) and 12B(b) illustrate a condition when the opening 18 is detached from the cleaning target 20 to open the opening 18 and sucking of air is conducted.

Before starting a cleaning operation, the cleaning member 5 is supplied in the casing 4. The cleaning member 5 supplied in the casing 4 can be retained inside the casing 4. As illustrated in FIG. 12B(b), the cleaning member 5 is adsorbed on the screen plate 14 and retained in the casing 4. Because the inside of the casing 4 is set at negative pressure condition by sucking of air, external air outside the casing 4 flows inside the casing 4 through the inlet 24. Because the flow speed and flow amount of the air flow inside the inlet 24 are both small under this condition, the intensity of the rotating air flow 30 generated in the casing 4 does not become the intensity that can fly the cleaning member 5.

Figure 12A:
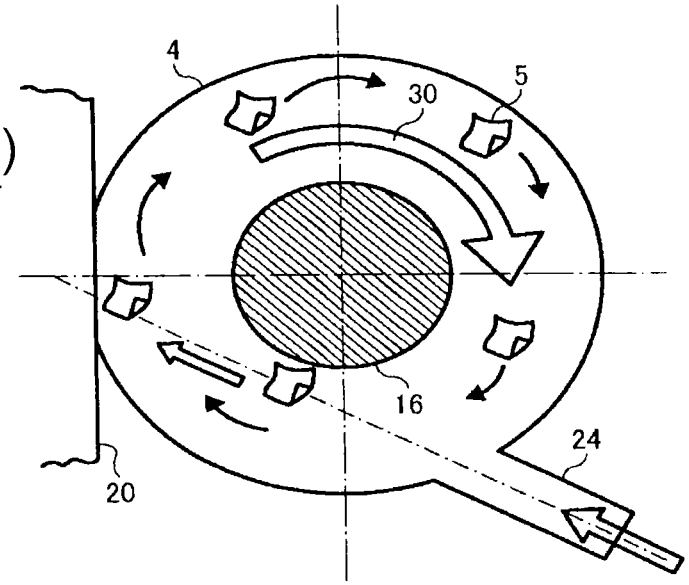
FIG. 12A(a) RELATED ART
FIGS. 12A(a), 12A(b), 12B(a) and 12B(b) are schematic cross-sectional views of the conventional dry cleaning apparatus indicating a basic of a cleaning operation.
Figure 12A:
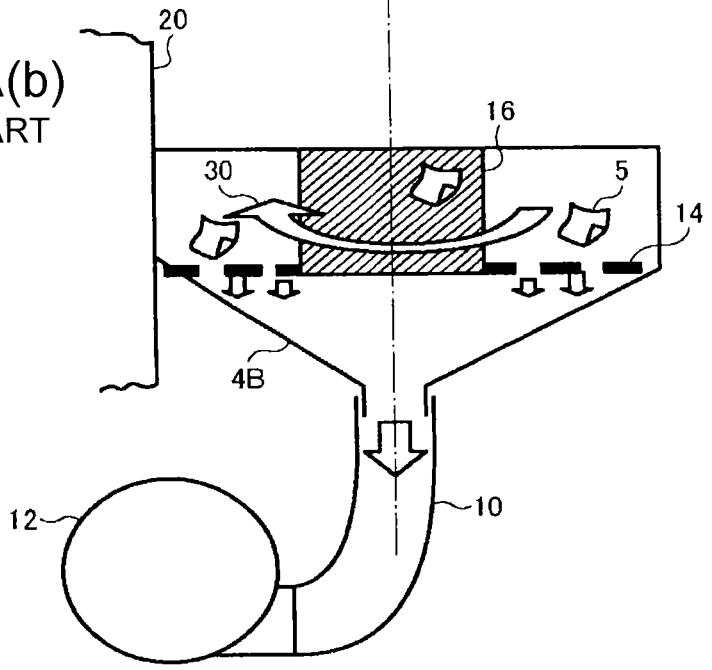
FIG. 12A(b) RELATED ART
Figure 12B:
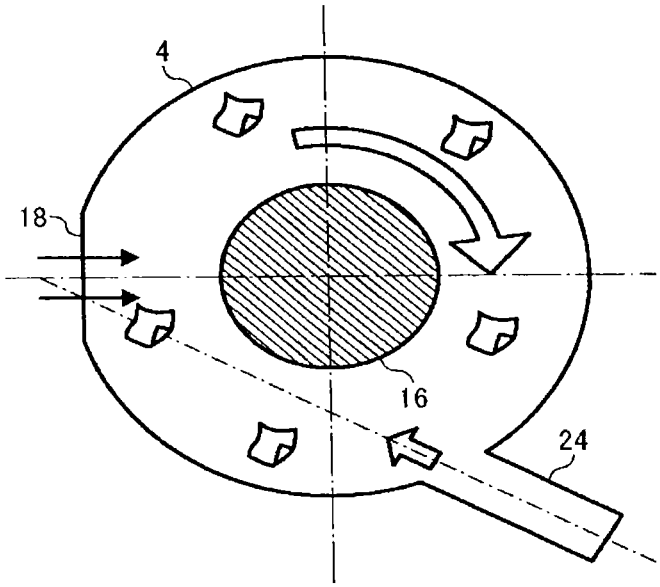
FIG. 12B(a) RELATED ART
Figure 12B:
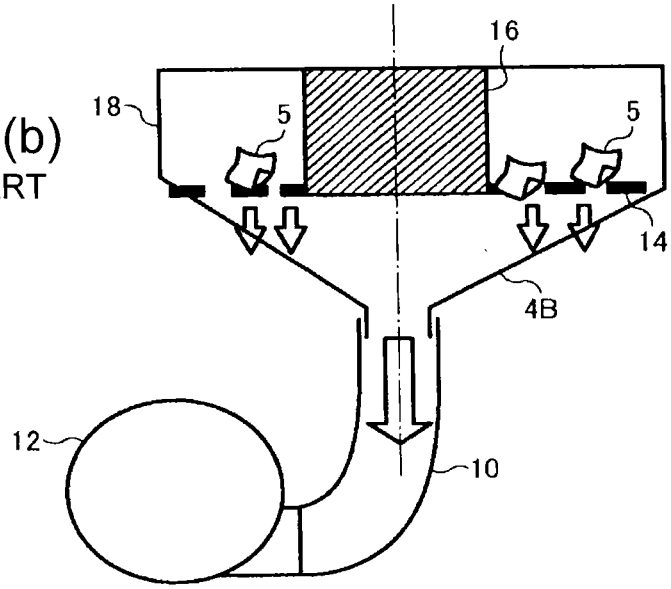
FIG. 12B(b) RELATED ART

Upon supplying and retaining the cleaning member 5 in the casing 4, as illustrated in FIG. 12A(a), the opening 18 is attached with a surface of the cleaning target 20, which is a to-be-cleaned portion, to set the closed condition of the opening 18. When the opening 18 is closed, because air suction from the opening 18 is stopped, the negative pressure in the casing 4 increases rapidly, and the flow speed and flow amount of air flow from the outside sucked through the inlet 24 increases. The sucked external air is guided inside the inlet 24, and then jetted from an exit of the inlet 24 (i.e., air-inflow port 22) inside the casing 4 as a high-speed airflow. The jetted air flow can fly the cleaning member 5 retained on the screen plate 14 toward the surface of the cleaning target 20 closing the opening 18.

The above mentioned air flow becomes the rotating air flow 30 and flows along the internal wall of the casing 4 as a circular flow, and a part of the air flow passes through the holes of the screen plate 14 and is sucked by the suction unit 6. When the rotating air flow 30 circularly flows inside the casing 4 and returns to the exit of the inlet 24, another air flow inflowing from the inlet 24 converges with the rotating air flow 30, with which the rotating air flow 30 is accelerated. With this configuration, the rotating air flow 30 can be generated stably in the casing 4.

The cleaning member 5 rotates in the casing 4 by the rotating air flow 30, and collides the surface of the cleaning target 20 repeatedly. With an effect of impact of this collision, contamination on the surface of the cleaning target 20 can be separated or removed from the cleaning target 20 as micro particles or powder. The separated or removed contamination can pass through the holes of the screen plate 14, and is then ejected outside the casing 4 by the suction unit 6.

A rotation axis of the rotating air flow 30 generated in the casing 4 is perpendicular to the surface of the screen plate 14, and the rotating air flow 30 becomes an air flow flowing in a direction parallel to the surface of the screen plate 14. Therefore, the rotating air flow 30 blows to the cleaning member 5 adsorbed on a surface of the screen plate 14 from a lateral direction, and intrudes into a space between the cleaning member 5 and the screen plate 14, can peel off the cleaning member 5, adsorbed on the screen plate 14, from the screen plate 14, and can re-fly the cleaning member 5, which may be referred to "re-fly effect."

Further, when the opening 18 is closed, negative pressure inside the upper casing 4A increases and becomes close to negative pressure set inside the lower casing 4B, in which adsorption force of the cleaning member 5 onto the surface of the screen plate 14 decrease, with which flying of the cleaning member 5 becomes easier.

Because the rotating air flow 30 is an air flow accelerated into one direction, high speed airflow can be generated easily, and high speed flying movement of the cleaning member 5 can be generated easily. The cleaning member 5 rotating at high speed is less likely adsorbed on the screen plate 14, and contamination adhered on the cleaning member 5 can be easily separated from the cleaning member 5 by centrifugal force.

A description is given of a first example embodiment according to the present invention with reference to FIGS. 1 to 9, in which the same parts used in the above described conventional configuration are indicated by the same references. Further, because cleaning operation and flying principle of the cleaning member 5 are same as the above described conventional configuration, and the dry cleaning apparatus can be used substantially same as the conventional configuration, the basic configuration of the dry cleaning apparatus is omitted in the following description.

Figure 2:
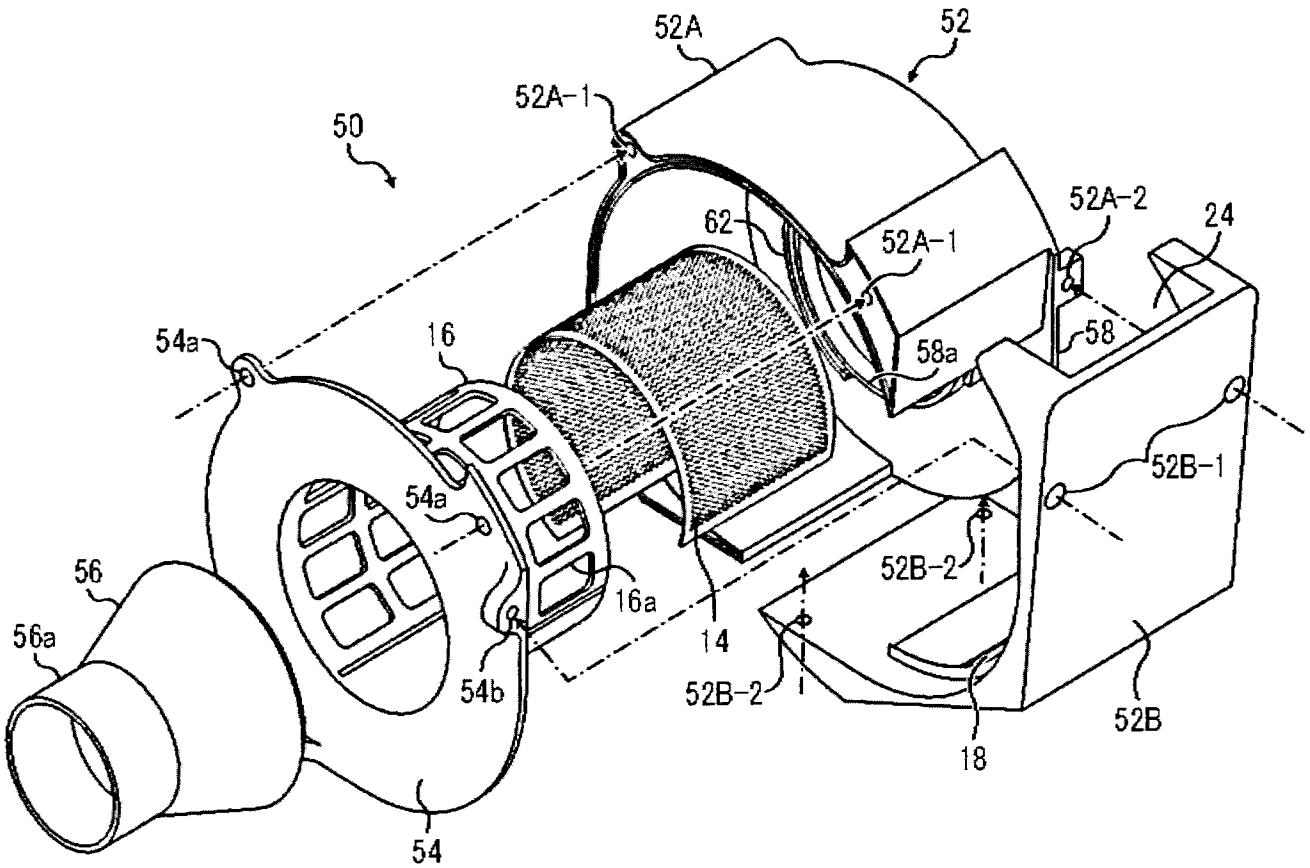
FIG. 2 is a perspective view of the dry cleaning casing of FIG. 1 when disassembled.

As illustrated in FIG. 2, a dry cleaning casing 50 (hereinafter, "casing 50") according to the first example embodiment integrally includes a casing body 52 of a cylinder shaped member, and the flow restriction member 16 having a cylinder shape. The casing 50 further includes a cover 54, a screen plate 14, and a dust collecting duct 56. The cover 54 covers an opening side of the casing body 52. The screen plate 14 is a porous plate attachable to an outer face of the flow restriction member 16. The dust collecting duct 56 is connected to the cover 54.

An inside of the flow restriction member 16 can be used as a suction route for the suction unit 6. A surface of the flow restriction member 16 is formed with a plurality of suction holes 16*a*, which are much greater than a mesh diameter of the screen plate 14. The inside of the flow restriction member 16 is communicated to the internal space of the casing 50 through the suction holes 16*a* and the screen plate 14.

The casing body 52 includes a first body unit 52A and a second body unit 52B, which can be separated. The first body unit 52A includes a side face 58 at an opposite position of the cover 54. An internal side of the side face 58 is formed with a receiving configuration to position the flow restriction member 16. The cover 54 has three screw holes 54*a*, and the first body unit 52A is formed with screw holes 52A-1 corresponding to the screw holes 54*a*. The cover 54 can be fixed to the first body unit 52A using screws.

The second body unit 52B includes the opening 18, and is formed with screw holes 52B-1 on a vertical face as illustrated in FIG. 2. The first body unit 52A and the cover 54 are respectively formed with screw holes 52A-2 and 54*b* corresponding to the screw holes 52B-1. An upper side of the second body unit 52B can be fixed to the first body unit 52A using screws.

A bottom face of the second body unit 52B is formed with screw holes 52B-2. The first body unit 52A is formed with screw holes corresponding to the screw holes 52B-2. The bottom face of the second body unit 52B can be fixed to the first body unit 52A using screws. In this case, the bottom face of the second body unit 52B is assembled under a bottom face of the first body unit 52A. When the first body unit 52A and the second body unit 52B are assembled, the inlet 24 can be formed at the upper side between the first body unit 52A and the second body unit 52B.

Figure 3:
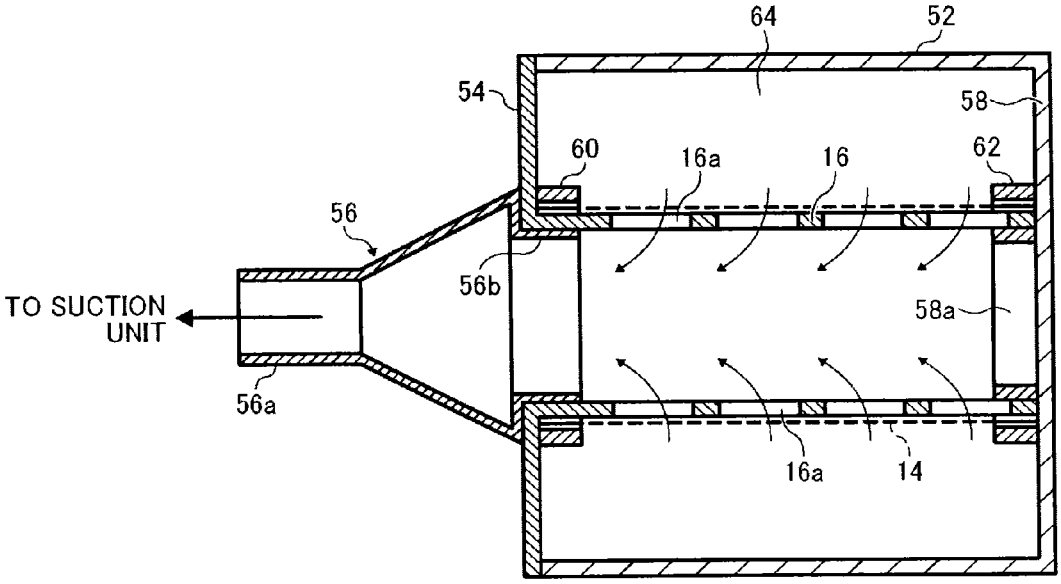
FIG. 3 is a schematic cross-sectional view of the dry cleaning casing of FIG. 1 showing air flow.

FIG. 3 is a schematic cross-sectional view of the dry cleaning casing 50. The flow restriction member 16 is formed at the inner side of the cover 54 integrally. A part of the cover 54 corresponding to the flow restriction member 16 is formed as an opening part.

The dust collecting duct 56 includes a suction port 56*a* connected to the suction hose 10, and a ring-shaped convex portion 56*b* formed at the opposite side of the suction port 56*a*. By pressing the ring-shaped convex portion 56*b* into the flow restriction member 16, the dust collecting duct 56 can be fixed to the cover 54, which means the cover 54, the flow restriction member 16 and the dust collecting duct 56 can be configured as one integrated unit. The cover 54 is detachable to the casing body 52, which means the flow restriction member 16 is detachably supported by the casing body 52.

Further, a ring-shaped convex portion 58*a* is formed at an inner side of the side face 58 of the first body unit 52A as a receiving configuration to position the flow restriction member 16. When assembling, a free end of the flow restriction member 16 is engaged to the ring-shaped convex portion 58*a*.

As illustrated in FIG. 3, a guide member 60 having an arc shape is formed on the cover 54, and a guide member 62 having an arc shape is formed on the side face 58 of the first body unit 52A. The guide members 60 and 62 are formed in line with a shape of an outer face of the flow restriction member 16. By inserting ends of the screen plate 14 in a gap between the guide member 60 and the flow restriction member 16, and a gap between the guide member 62 and the flow restriction member 16, the screen plate 14 can be attached along the outer face of the flow restriction member 16.

In this example embodiment, the screen plate 14 is shaped into a curled shape so that the screen plate 14 can fit to a shape of the outer face of the flow restriction member 16. By setting or attaching the screen plate 14 on the outer face of the flow restriction member 16 and then inserting the cover 54 into the casing body 52, the assembly work completes.

The screen plate 14 can be fixed on the flow restriction member 16 just by attaching the screen plate 14 on the outer face of the flow restriction member 16 because the screen plate 14 can be pulled toward the flow restriction member 16 by a suction air flow from the dust collecting duct 56 during a cleaning operation.

As illustrated in FIG. 1, the cleaning member 5 flying in an internal space 64 (i.e., rotating flow path) of the casing 50 by the rotating air flow 30 can be accelerated by an air flow inflowing from the inlet 24, and then the cleaning member 5 collides the surface of the cleaning target 20 at the opening 18 with high speed. With this configuration, contamination substance 66 can be removed from the surface of the cleaning target 20.

While the air flow inflowing from the inlet 24 rotates along the rotating flow path, the air flow moves into inside the flow restriction member 16 through the screen plate 14, and then the air flow is ejected to the dust collecting duct 56. By using this air flow, substance that can pass through the mesh holes (i.e., mesh diameter) of the screen plate 14 such as smaller contamination substance 66*a*, which becomes smaller than the contamination substance 66, and cleaning member 5*a*, which becomes smaller than the cleaning member 5 by wearing, may flow inside the flow restriction member 16, and is ejected to the dust collecting duct 56. In FIG. 1, the guide members 60 and 62 are omitted.

A greater mass substance such as the cleaning member 5 having less wearing or folding, and the contamination substance 66 flies the outer side of the rotating flow path with an effect of the centrifugal force. Therefore, the cleaning member 5 and the contamination substance 66 may not contact the screen plate 14, disposed at the inner side of the rotating air flow 30, so often.

Smaller mass substance such as the size-reduced cleaning member 5*a* and size-reduced contamination substance 66*a* having reduced its size during the cleaning operation collides the screen plate 14 in a direction along the air flow, with which damage to the screen plate 14 by friction can be less likely occur.

When the screen plate 14 having a smaller mesh diameter is used, thickness of the screen plate 14 becomes thinner due to manufacturing limitation. By attaching the screen plate 14 to the flow restriction member 16, damage to the screen plate 14 by friction can be reduced, with which breaking of the screen plate 14 can be reduced.

Further, in the above described configuration, the screen plate 14 is prepared as a separate part, and attached to the flow restriction member 16 and supported by the flow restriction member 16, with which the screen plate 14 having a smaller mesh diameter can be employed.

In the above described configuration, the flow restriction member 16 retains the screen plate 14 of cylinder shape, with which stiffness of the screen plate 14 can be maintained against negative pressure for any thickness of the screen plate 14, and against collision with the cleaning member and the contamination substance during the cleaning operation.

When the type of contamination of a cleaning target changes, the cleaning member 5 is changed, in which the screen plate 14 is required to be replaced with a screen plate matched to the changed cleaning member 5. In the above described first example embodiment, the cover 54 is removed from the casing body 52, and the screen plate 14 is replaced with a new one. Then, by assembling the new screen plate 14, a desired replacement can be conducted. In the above described configuration, because the screen plate 14 is just fit on the outer face of the flow restriction member 16, the screen plate 14 can be easily replaced. Further, compared to conventional disassembly that disassembles almost entire parts of the casing, the replacement work can be conducted easily by just removing the cover 54 in the above described configuration.

Figure 4:
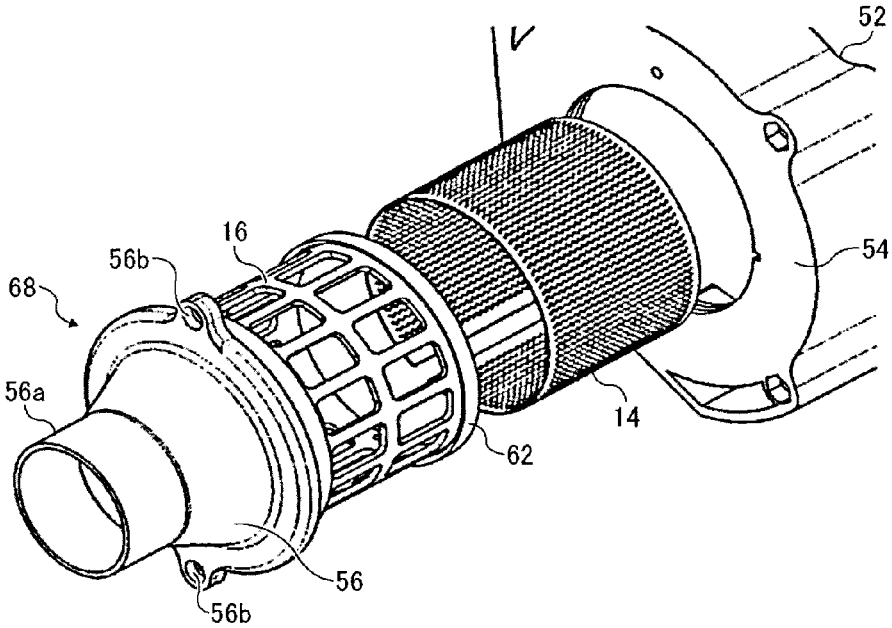
FIG. 4 is a perspective view of disassembled another dry cleaning casing, in which a screen plate can be replaced without disassembly.

FIG. 4 is another example configuration of a casing, in which the screen plate 14 is replaceable without disassembling the casing, in which the dust collecting duct 56 and the flow restriction member 16 are integrated as one unit, which is referred to as a unit 68. The dust collecting duct 56 has a screw hole 56*b*, the dust collecting duct 56 is formed with the guide member 60 integrally, and the flow restriction member 16 is formed with the guide member 62 integrally.

An opening is formed at a part of each of the guide members 60 and 62. The screen plate 14 can be attached on the flow restriction member 16 by inserting one end of the screen plate 14 from the opening along the outer face of the flow restriction member 16. Further, the screen plate 14 can be attached on the flow restriction member 16 by engaging one end of the screen plate 14 to any one of the guide members 60 and 62, and then engaging another end of the screen plate 14 to another one of the guide members 60 and 62 by deforming the screen plate 14.

The unit 68 can be fixed to the cover 54 using the screw hole 56*b* and a screw. If a configuration not having the cover 54 is employed, the unit 68 can be directly fixed to the casing body 52.

When the unit 68 is inserted into the casing body 52, an inserting direction end of the flow restriction member 16 engages the ring-shaped convex portion 58*a* of the side face 58, with which the flow restriction member 16 is positioned at a desired position. Under this condition, the unit 68 is fixed to the casing body 52 using the screw hole 56*b* and a screw.

When replacing the screen plate 14, the screw is removed from the screw hole 56*b* to take out the unit 68, and the screen plate 14 is replaced with a desired screen plate 14, and then the unit 68 is re-assembled.

In the configuration illustrated in FIG. 3, unlocking of fixed condition of the cover 54 to the casing body 52, and unlocking of fixed condition of the second body unit 52B to the cover 54 are required. In the configuration illustrated in FIG. 4, only unlocking of fixed condition to the casing body 52 is required, with which replacement work can be further simplified.

Figure 5:
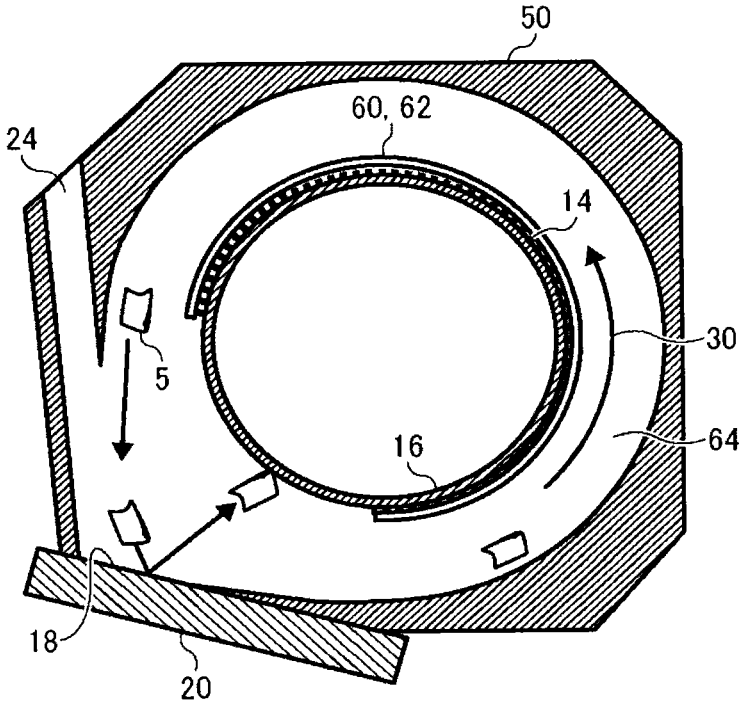
FIG. 5 is a schematic cross-sectional view of the dry cleaning casing of FIG. 1 illustrating bouncing of cleaning member that has collided a cleaning target.

As illustrated in FIG. 5, the screen plate 14 does not exist at an area of the flow restriction member 16 facing the opening 18. Further, at this area, the suction holes 16*a* are not formed on the flow restriction member 16. After the cleaning member 5 collides the cleaning target 20, the cleaning member 5, reflected from the cleaning target 20, may fly to the flow restriction member 16 with a higher probability. Therefore, if the screen plate 14 is disposed near this area, damage by collision of the cleaning member 5 becomes greater, which may result into higher replacement frequency of the screen plate 14.

Further, if the suction holes 16*a* is formed at this area, the cleaning member 5, not yet worn out too much, may be also ejected, with which cleaning capability deteriorates earlier and supply frequency of the cleaning member 5 becomes higher. In view of such concerns, an area of the outer face of the flow restriction member 16 covered by the screen plate 14 is set to a given size, and the length of the guide members 60 and 62 are set in view of the area of the flow restriction member 16 covered by the screen plate 14. By using a configuration not disposing the screen plate 14 near the opening 18, damage to the screen plate 14 caused by the cleaning member 5 can be prevented, and lifetime of the screen plate 14 can be enhanced.

In the above described configuration, the screen plate 14 is replaced by removing the cover 54, but other replacement work can be conducted by using a flexible screen plate having thin thickness. For example, a screen plate, which is a flexible plate having thin thickness can be replaced through the opening 18 as illustrated in FIGS. 6A and 7.

Figure 6A:
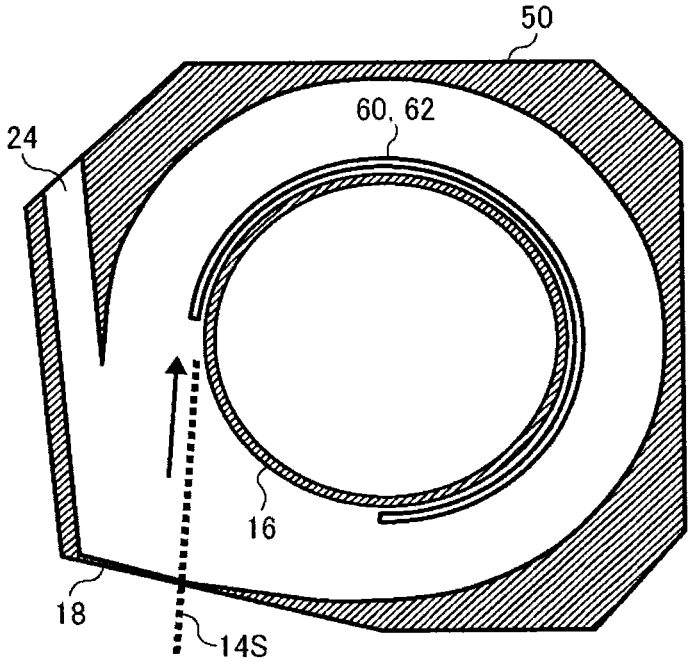
Figure 6B:
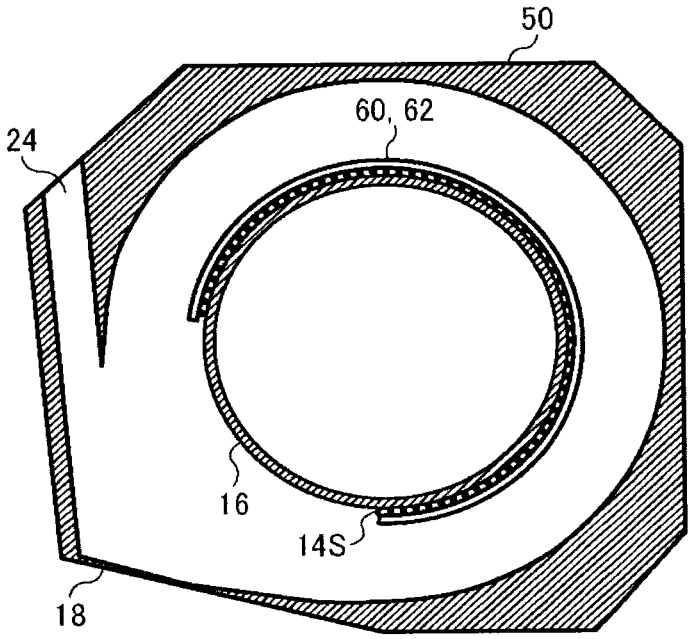
Figure 7:
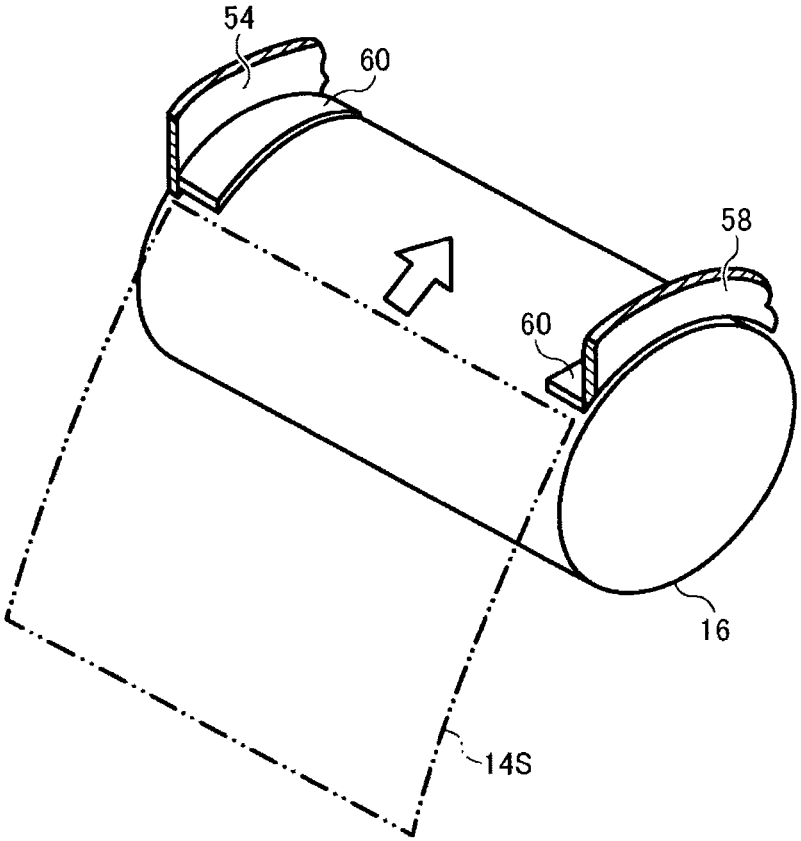
FIG. 7 is a perspective view of a dry cleaning casing when attaching the screen plate by inserting through the opening.

As illustrated in FIGS. 6A and 7, a thin screen plate 14S not having a curled shape can be inserted from the opening 18, and a front end of the screen plate 14S is inserted and pushed into the guide members 60 and 62. Because the screen plate 14S is a thin flexible plate, the screen plate 14S can be moved along the outer face of the flow restriction member 16. Upon completing the insertion, the screen plate 14S can be attached as illustrated in FIG. 6B. In this configuration, the screen plate 14S is detachable to the flow restriction member 16 by inserting and removing the screen plate 14S through the opening 18. In this configuration, an end of the guide members 60 and 62 at the inlet 24 side is used as an inserting start end of the screen plate 14, but the screen plate 14 can be inserted from the opposite side.

The screen plate 14S is formed with a hook hole at an inserting direction end so that the screen plate 14S can be removed by using a tool having a hook end that can be hooked to the hook hole. Further, the screen plate 14S can be removed by pinching an end of the screen plate 14S using a plier.

In this replacement work, the screen plate 14S can be replaced without removing the cover 54, which means the screen plate 14S can be replaced under the assembled condition of the flow restriction member 16 to the casing 50, with which a replacement work can be simplified.

The screen plate 14S is a porous plate such as a punched metal having a number of holes. Specifically, the screen plate 14S is a porous plate having a greater number of small holes having a size that does not pass through the cleaning member 5 to the suction unit side but can pass through air and dust (e.g., removed substance removed from cleaning target), and the screen plate 14S can be a slit plate and a net. Material of screen plate 14S can be resin and metal having a smooth face. Typically, thickness of the screen plate is equal to a hole diameter or less. Therefore, if a mesh diameter is too small, the screen plate may need reinforcement by rib or by stacking a plurality of plates. In the above described configuration, the thickness of the screen plate 14S is preferably about 0.05 mm to 0.5 mm in view of efficiency of insertion and removing.

Figure 8:
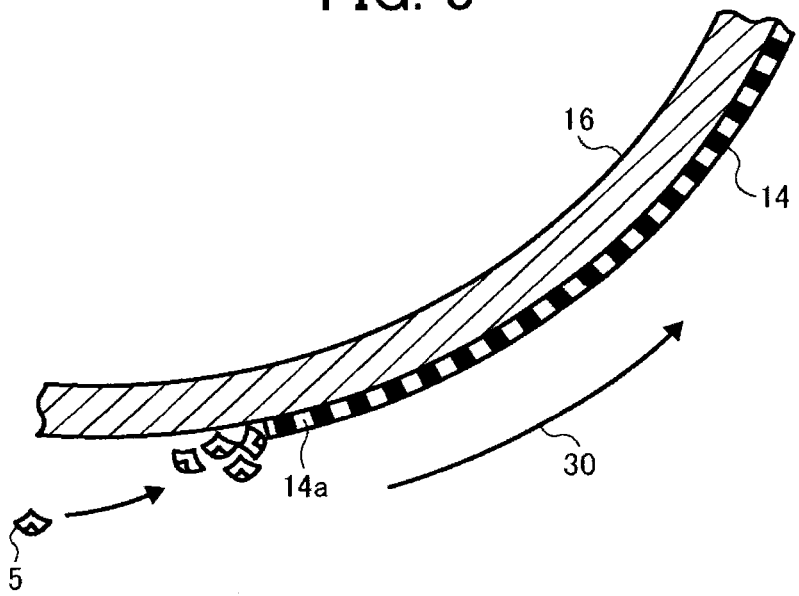
FIG. 8 is a schematic cross-sectional view of a flow restriction member and a screen plate attached on the flow restriction member, in which a problem occurs at an end of the screen plate opposing a movement direction of rotating air flow.

As illustrated in FIG. 1, as to ends of the screen plate 14 attached to the flow restriction member 16, a front end 14*a* of the screen plate 14, which is closer to the opening 18, faces the upstream side of rotating air flow generated by air flow inflowing from the inlet 24 with a counter direction of the movement direction of rotating air flow. If the front end 14*a* of the screen plate 14 is set as illustrated in FIG. 1, as illustrated in FIG. 8, the cleaning member 5 may stick and pile up at a gap between the screen plate 14 and the flow restriction member 16. This sticking and piling up may occur when thin leaf cleaning member is used. Under such condition, amount of cleaning member used for cleaning decreases, damage occurs at the end of the screen plate 14, and further the cleaning member becomes a wedge that hinders the replacement of the screen plate 14.

Figure 9A:
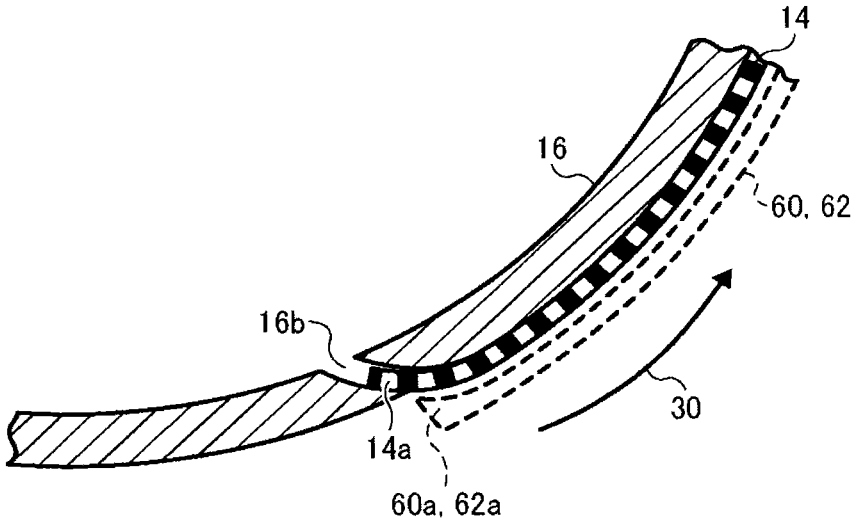
FIGS. 9A and 9B are schematic cross-sectional views of a flow restriction member and a screen plate attached on the flow restriction member solving the problem illustrated in FIG. 8.
Figure 9B:
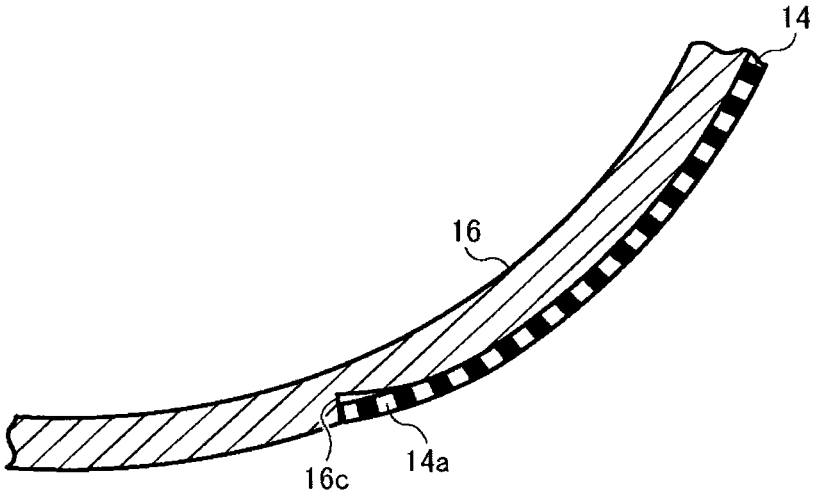

In the above described example embodiment, to cope with this issue, as illustrated in FIG. 9(*a*), a slit 16*b* is formed on the flow restriction member 16, and convex guides 60*a* and 62*a* are formed for the guide members 60 and 62. In this configuration, the front end 14*a* of the screen plate 14 can be inserted into the flow restriction member 16, and the convex guides 60*a* and 62*a* respectively formed on the guide members 60 and 62 can guide the front end 14*a* of the screen plate 14 to the slit 16*b*. The slit 16*b* is slanted to a direction with respect to the movement direction of the rotating air flow 30. Therefore, when the front end 14*a* of the screen plate 14 is inserted into the slit 16*b*, there is no gap between the screen plate 14 and the flow restriction member 16, with which the cleaning member 5 can be guided smoothly and thereby piling up of the cleaning member 5 may not occur. With this configuration, intrusion of the cleaning member 5 to the gap can be prevented.

Further, as illustrated in FIG. 9(*b*), a concave portion 16*c* can be formed on the outer face of the flow restriction member 16. The front end 14*a* of the screen plate 14 can be fit into the concave portion 16*c* without deviation to the outside. Similar to the configuration of FIG. 9A, the front end 14*a* of the screen plate 14 can be guided to the concave portion 16*c* by using the guide members 60 and 62. When the screen plate 14 is a curled member, the front end 14*a* of the screen plate 14 can be inserted into the slit 16*b* or the concave portion 16*c* automatically without forming the convex guide to the guide members 60 and 62.

At a rear end 14*b* of the screen plate 14 (see FIG. 1) positioned at the downstream of the rotating air flow 30, no gap occurs between the screen plate 14 and the flow restriction member 16 with respect to the movement direction of the rotating air flow 30. Therefore, a configuration to fit the rear end 14*b* of the screen plate 14 into the flow restriction member 16 may not be required.

Figure 10:
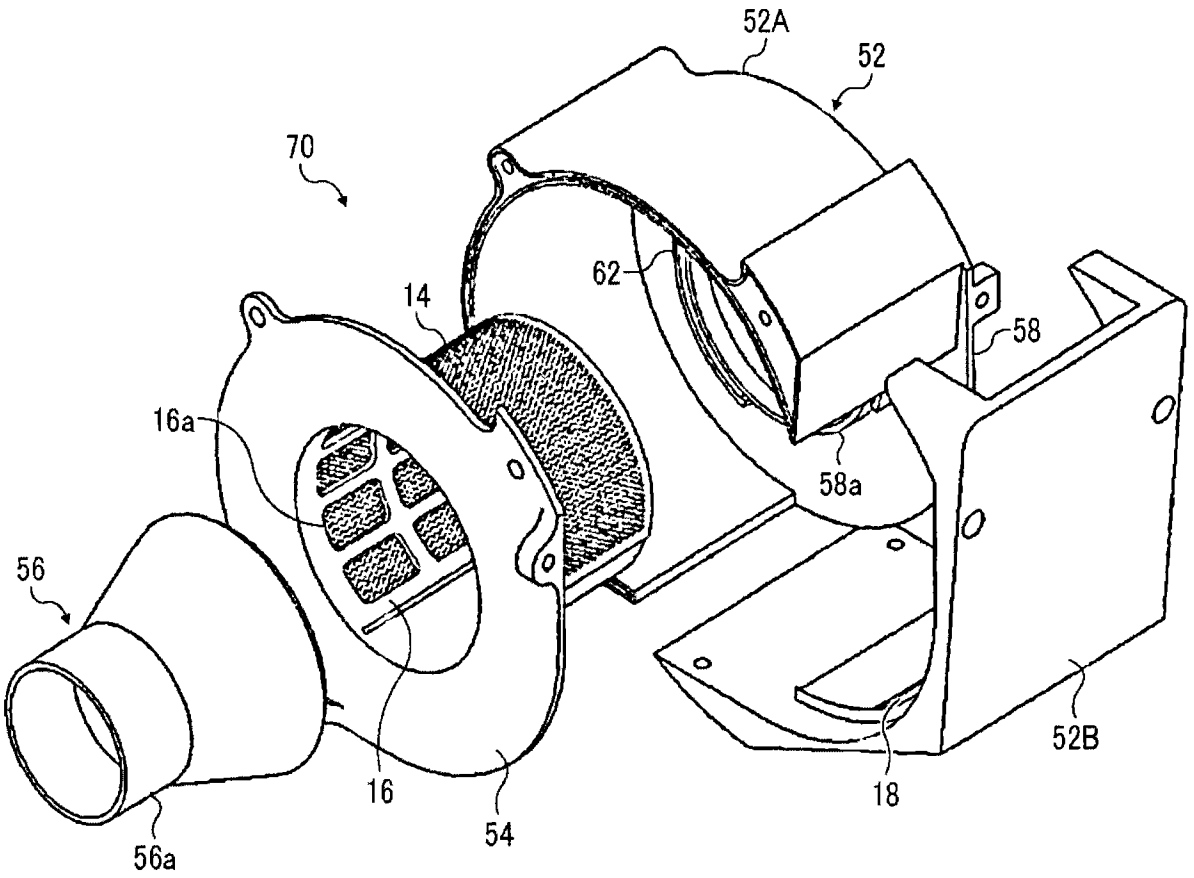
FIG. 10 is a perspective view of a dry cleaning casing of a second example embodiment when disassembled.

A description is given of a second example embodiment with reference to FIG. 10, in which parts same as the above described first example embodiment are attached with the same references, and a description of the same parts and functions is omitted. As to the above described first example embodiment, the screen plate 14 is detachable to the flow restriction member 16, and only the screen plate 14 is replaceable.

As to the second example embodiment, the screen plate 14 is integrally fixed to the flow restriction member 16. When replacing the screen plate 14 depending on types of the cleaning member 5, a unit 70 integrating the cover 54, the flow restriction member 16, and the screen plate 14 is replaced. This configuration may increase cost compared to the replacement of the screen plate 14 alone, but the replacement work by removing the screen plate 14 can be omitted for the second example embodiment, in which the replacement work of the screen plate 14 can be conducted by only removing the cover 54 from the casing body 52, with which the replacement work can be simplified.

In the second example embodiment too, the screen plate 14 is prepared as a separate part and fixed to the flow restriction member 16 and supported by the flow restriction member 16, with which stiffness issue of the screen plate 14 can be solved, with which a screen plate having a smaller mesh diameter can be employed.

As to the second example embodiment, the cover 54 is integrally formed with the flow restriction member 16, but the cover 54 can be a separate part detachable from the flow restriction member 16. Further, the screen plate 14 is attached to the outer face of the flow restriction member 16, but the screen plate 14 can be attached to an inner face of the flow restriction member 16 depending on stiffness of the screen plate 14. Further, the flow restriction member 16 extends along the entire of the rotation axis direction in the casing, but the flow restriction member 16 may extend partially along the rotation axis direction and the screen plate 14 of cylinder shaped member can be disposed for the remaining part of the rotation axis direction.

As to the above described dry cleaning casing according to the example embodiments, mesh diameter of a screen plate can be changed easily and less costly in view of types of contamination of cleaning target, and efficient cleaning capability can be obtained.

As to the above described dry cleaning casing according to the example embodiments, when contamination type of a cleaning target is changed, and then types of cleaning member is changed, a screen plate suitable for contamination type and cleaning member type can be employed, and a replacement work of screen plate can conducted easily. Therefore, the replacement work can be efficiently conducted while setting a suitable cleaning capability. Further, a screen plate having a small hole diameter can be used without concerning stiffness issue.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A dry cleaning casing of a dry cleaning apparatus useable for cleaning a cleaning target by impacting a cleaning member to the cleaning target by flying the cleaning member using an air flow, the dry cleaning casing comprising:

a casing body including an internal space, connected to a suction mechanism;

an opening to which the cleaning target is to be contacted; and an air introduction route to introduce external air to the internal space, by sucking air from the internal space while the opening is closed by the cleaning target, to generate rotating air flow to make the cleaning member fly;

a flow restriction member to define a rotation axis of the rotating air flow in the internal space, the flow restriction member having an inner space communicating with the internal space and used as a suction route for the suction mechanism;

a screen plate made of a porous plate to block movement of the cleaning member to the suction mechanism and to allow substance removed from the cleaning target to pass through, the screen plate disposable on the flow restriction member along an outer face of the flow restriction member such that air can flow through the screen plate and the flow restriction member into the inner space, and a guide member to attach the screen plate along the outer face of the flow restriction member, wherein the screen plate is detachably supported by the flow restriction member, wherein the guide member is disposed to guide the screen plate along the outer face of the flow restriction member, wherein a front end of the screen plate positioned at upstream side of rotating air flow is set to block intrusion of the cleaning member into a gap between the flow restriction member and the screen plate, and wherein the front end of the screen plate fits in the flow restriction member when the screen plate is attached to the flow restriction member.

2. The dry cleaning casing of claim 1, wherein while the flow restriction member is being assembled to the dry cleaning casing, the screen plate is attachable and detachable from the flow restriction member by inserting and removing the screen plate through the opening.

3. The dry cleaning casing of claim 1, wherein the screen plate is disposed along the outer face of the flow restriction member other than an area facing an opening of the flow restriction member.

4. The dry cleaning casing of claim 1, wherein the flow restriction member is detachably supported by the dry cleaning casing.

5. A dry cleaning apparatus comprising:

the dry cleaning case of claim 1; and the cleaning member.

6. A method of attaching a screen plate for a dry cleaning casing of a dry cleaning apparatus useable for cleaning a cleaning target by impacting a cleaning member to the cleaning target by flying the cleaning member using an air flow, the dry cleaning casing including a casing body including an internal space, connected to a suction mechanism, for flying the cleaning member;

an opening to which the cleaning target is contacted to collide the cleaning member to the cleaning target; and an air introduction route to introduce external air to the internal space, by sucking air from the internal space while the opening is closed by the cleaning target, to generate rotating air flow to make the cleaning member fly;

a flow restriction member to define a rotation axis of rotating air flow in the internal space, the flow restriction member having an inner space communicating with the internal space and used as a suction route for the suction mechanism; and a screen plate made of a porous plate to block movement of the cleaning member to the suction mechanism and to allow substance removed from the cleaning target to pass through, the screen plate disposable on the flow restriction member along an outer face of the flow restriction member, the method comprising:

inserting the screen plate from the opening of the casing body; and inserting with pressure a front end of the screen plate into a guide member formed along the flow restriction member to attach the screen plate along an outer face of the flow restriction member.

7. The method of claim 6, further comprising forming a depression on the flow restriction member such that the front end of the screen plate can be inserted into the depression.

* * * * *